US009195159B2

(12) United States Patent
Kamiyama

(10) Patent No.: US 9,195,159 B2
(45) Date of Patent: Nov. 24, 2015

(54) IMAGE FORMING APPARATUS

(71) Applicant: KYOCERA Document Solutions Inc., Osaka (JP)

(72) Inventor: Yuji Kamiyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/523,569

(22) Filed: Oct. 24, 2014

(65) Prior Publication Data

US 2015/0117912 A1 Apr. 30, 2015

(30) Foreign Application Priority Data

Oct. 31, 2013 (JP) ..... 2013-226651

(51) Int. Cl.
*G03G 15/01* (2006.01)

(52) U.S. Cl.
CPC ..... *G03G 15/0131* (2013.01)

(58) Field of Classification Search
CPC ..... G03G 15/0131; G03G 15/0158; G03G 2215/0161
See application file for complete search history.

(56) References Cited

U.S. PATENT DOCUMENTS

2005/0024479 A1* 2/2005 Itabashi et al. ..... 347/243
2008/0226360 A1* 9/2008 Sugiyama ..... 399/301
2012/0008993 A1* 1/2012 Maeda ..... 399/301

FOREIGN PATENT DOCUMENTS

JP 2012-18279 A 1/2012

* cited by examiner

*Primary Examiner* — Sandra Brase
(74) *Attorney, Agent, or Firm* — Stein IP, LLC

(57) ABSTRACT

The exposing unit emits a pair of light beams deflected to reverse scanning directions each other by a rotary polyhedron. The pattern creation unit creates color misregistration detection patterns on the transfer unit by the toner image in a reference color formed by a light beam emitted from an exposing unit and the toner image in an adjustment color formed by the other light beam having a different scanning direction. The color misregistration correction unit, on the basis of the image forming position of the toner image in the reference color, moves an image forming position of the toner image in each color formed by the light beam having the scanning direction opposite to the light beam corresponding to the reference color according to the color misregistration adjustment amount detected by the adjustment amount detection unit.

4 Claims, 8 Drawing Sheets

IMAGE FORMING APPARATUS

CROSS-REFERENCE TO RELATED APPLICATIONS

This application claims the benefit of Japanese Patent Application No. 2013-226651, filed on Oct. 31, 2013, all of which is hereby incorporated by reference in its entirety.

BACKGROUND OF THE INVENTION

The present disclosure relates to image forming apparatus that performs the image forming by overlaying at least two of image in each color formed for every color.

In recent years, the image forming apparatus corresponding to full color is widely diffused. In such full color image forming apparatus, the full color image is formed by overlaying individual color images (toner images) formed for every color, C (cyan), M (magenta), and Y (yellow). One of the image forming methods is a tandem electrographic in which each color toner image in C (cyan), M (magenta), Y (yellow) and K (black) is formed by respective image forming units. In the tandem electrographic, the image forming units for CMYK colors are disposed along a traveling direction of the transfer belt. The timing of forming the toner image by each image forming unit is controlled so as to transfer the toner images formed by the image forming units to a same position of the transfer belt.

In such image forming apparatus for forming one image by overlaying the individual images formed for every color, when the misalignment of the overlaid color images (namely, the color misregistration) occurs, the quality of image thus formed decrease remarkably. The occurrence of the color misregistration is caused by the change of the position relation between the optical units for guiding the light beam to form the electric latent image on the photosensitive drum in each image forming unit depending on the ambient environment like the temperature. Therefore, such kind of image forming apparatus is configured so as to form appropriately on the transfer belt a pattern for detecting the color misregistration, and correct the color misregistration according the detection result.

However, the color misregistration correction requires forming the color misregistration detection pattern for each color, and it takes a long time for executing the color misregistration correction. Accordingly, in case of increasing the frequency of the color misregistration correction, the deterioration of the picture quality can be suppressed but the performance of the image forming apparatus is reduced extremely. In case of extending the interval of the execution of the color misregistration correction, it is hard to suppress the deterioration of the picture quality caused by the color misregistration. Therefore, various kinds of technique for the color misregistration correction have been proposed.

There is an image forming apparatus having a LSU (Laser Scanning Unit) wherein only one polygon mirror deflects the light beam emitted from the light source corresponding to each color, the color misregistration correction is carried out for each group of colors sharing an optical element by means of a representative color of the group.

In the other image forming apparatus, the color misregistration correction is carried out by estimating the misalignment reading amount of the reference pattern in color, the color for which the reference pattern is not formed, according to the misalignment reading amount of the reference pattern formed by some units of imaging units and the misalignment reading amount of the reference patterns in every colors that have been stored in the misalignment reading storage unit.

Moreover, in the image forming apparatus including a three-color-integrated type transfer member, which is capable for switching the monochrome printing and the color printing, the color registration correction is carried out by using the registration marks formed in black and one color of the three color-integrated type transfer member.

In addition, in the other image forming apparatus, a rough adjustment of the color misregistration is carried out by using registration marks formed in black and one of colors to be used to the color image formation, and after that, a fine adjustment of the color misregistration for every color is carried out on the basis of the reference color that is the color used to the rough adjustment.

Regarding the scanning optical unit (LSU) to be implemented to the tandem type of image forming apparatus, there are various structures. For instance, there is a structure wherein the scanning optical unit including one light source, one polygon mirror and one light-emitting optical system is arranged for each imaging unit. There is another structure wherein the scanning optical unit including four light sources, one polygon mirror and two light-emitting optical system (f-θ lens) is arranged for all the imaging units. The latter structure has an advantage that the number of components can be reduced in comparison to the former structure. But, the optical system becomes complicated since the two light beams shares the same light emitting optical system, and it is not easy to adjust the optical system.

There is still another structure wherein one scanning optical unit including two light sources, one polygon mirror, and two light-emitting optical systems disposed facing each other across the polygon mirror is disposed for two imaging units. Specifically, two scanning optical units are placed for four imaging units. In such structure, the number of polygon mirrors can be reduced in comparison to the structure arranging the scanning optical unit for each imaging unit, and the optical system does not become complicated excessively like the structure arranging one scanning optical unit for all the imaging units.

In the image forming apparatus applying those scanning optical units, the color misregistration correction is indispensable. In the image forming apparatus in the present disclosure, the relation between the picture quality and the performance of the image forming apparatus is a trade-off relation as described above, and there is a problem to be solved.

However, it is difficult to apply the above-mentioned color registration correction using only the representative color of the color group to the configuration in the present disclosure wherein the light-emitting system is not shared. The method for estimating the misalignment reading amount of the reference pattern in color for which the reference patterns is not formed is deemed to be applicable to the image forming apparatus in the present disclosure, but the apparatus is required to have the misalignment reading storage unit for storing the misalignment reading amount for the reference patterns in all colors. The technology using a three-color-integrated type transfer member cannot be applied to the present disclosure if the color transfer member is not the three-color-integrated type. Moreover, in case of the technology of the color misregistration correction by executing the fine adjustment for every color after the rough adjustment using the registration mark in one color, the reference patterns for all colors are formed at the fine adjustment, so that the effect of suppressing the performance reduction is relatively small. Therefore, in the image forming apparatus in the present disclosure, the above-mentioned technologies do not function adequately as the technology for suppressing the deterioration of the picture quality and the reduction of performance.

SUMMARY OF THE INVENTION

The present disclosure assumes an image forming apparatus configured to form an image by overlaying images formed separately for every color. The image forming apparatus in the disclosure includes an exposing unit, image carriers, developing units, a transfer unit, a pattern creation unit, an adjustment amount detection unit, and a color misregistration correction unit. The exposing unit is configured to emit a pair of light beams that are deflected to reverse scanning directions each other by a rotary polyhedron. The image carriers are disposed for every color and corresponding to respective light beams emitted from the plural exposing units, and each image carrier has an image carrier surface on which the corresponding light beam forms a latent image. The developing units are configured to form toner images corresponding to the latent images by sticking the toner onto the latent images on the image carrying surfaces. The transfer unit is configured to transfer thereon the toner images carried by the image carrying surfaces of the image carriers. The pattern creation unit is configured to create color misregistration detection patterns on the transfer unit by the toner image in a reference color formed by a light beam emitted from an exposing unit and the toner image in an adjustment color formed by the other light beam having a different scanning direction from the light beam emitted from the exposing unit. The adjustment amount detection unit is configured to detect a color misregistration adjustment amount by means of the color misregistration detection patterns created on the transfer unit. The color misregistration correction unit is configured to, on the basis of the image forming position of the toner image in the reference color, move an image forming position of the toner image in each color formed by the light beam having the scanning direction opposite to the light beam corresponding to the reference color, according to the color misregistration adjustment amount detected by the adjustment amount detection unit.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

The embodiment of the present disclosure will be explained in detail according to the attached figures. The present disclosure is materialized by a digital multifunction peripheral.

Figure 1:
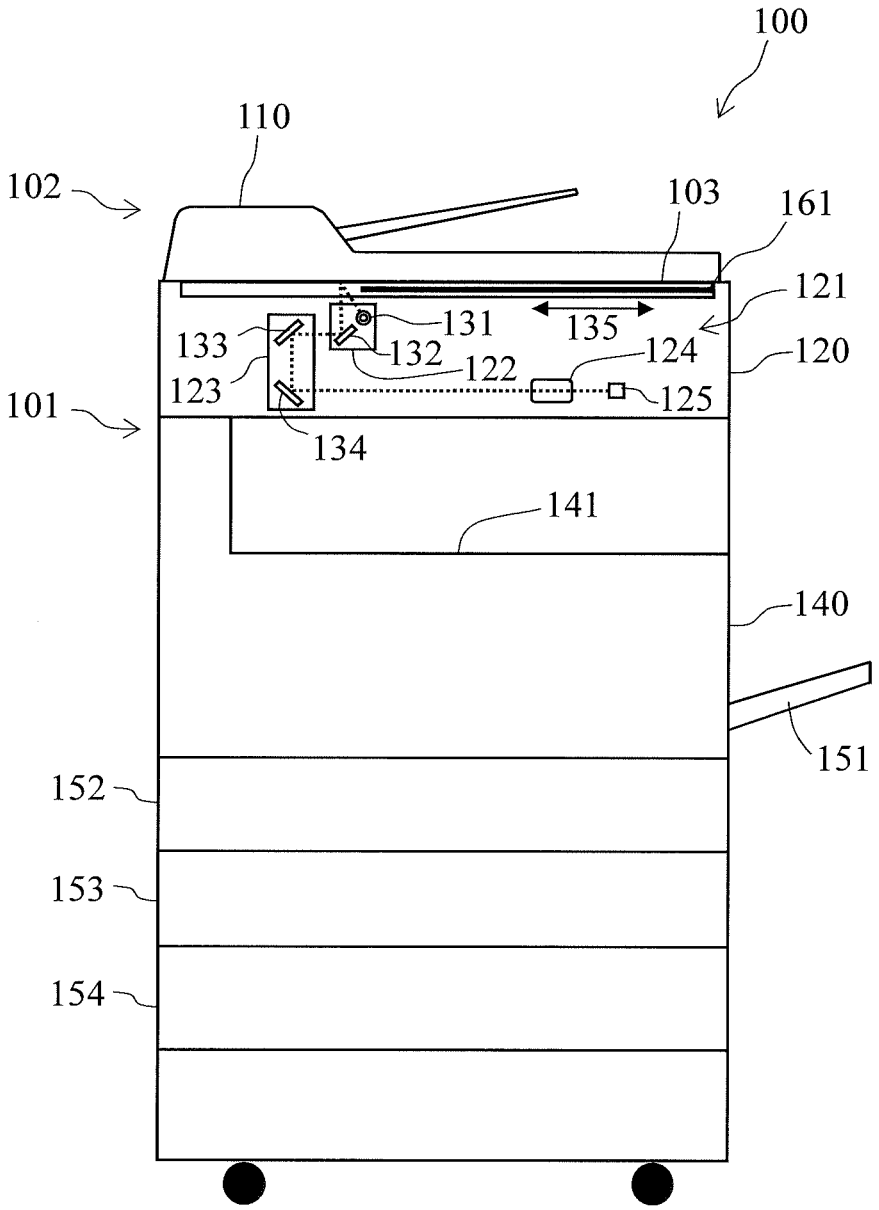
FIG. 1 is a schematic view showing a whole structure of a multifunction peripheral in accordance with an embodiment of the present disclosure.

FIG. 1 is a schematic view showing the whole structure of the digital multifunction peripheral in this embodiment. As shown in FIG. 1, the multifunction peripheral 100 includes a base machine 101 having an image reading unit 120 and an image forming unit 140, and a platen cover 102 placed over the base machine 101. An original plate 103, which is made of a transparent plate like a glass, is disposed on a top surface of the base machine 101. The original plate 103 is opened and closed by the platen cover 102. The platen cover 102 is provided with a document feeder 110. The multifunction peripheral 100 is provided on its front side with an operation panel 161 whereby user can give the multifunction peripheral 100 a copy start instruction and other instructions, and also confirm a status or setting of the multifunction peripheral 100.

The image reading unit 120 is disposed below the original plate 103. The image reading unit 120 reads an image of an original by a scanning optical system 121, and creates digital data of the image (image data). The original can be placed on the original plate 103 or the document feeder 110. The scanning optical system 121 includes a first carriage 122 and a second carriage 123, and a condenser lens 124. The first carriage 122 is provided with a linear light source 131 and a mirror 132, and the second carriage 123 is provided with mirrors 133 and 134. The light source 131 illuminates the original. The mirrors 132, 133 and 134 guide the light reflected from the original to the condenser lens 124, and the condenser lens 124 forms a light image on a light receiving surface of a line image sensor 125.

In the scanning optical system 121, the first carriage 122 and the second carriage 123 are disposed so as to reciprocate in a sub-scanning direction 135. The image sensor 125 can read the image of the original placed on the original plate 103 by moving the first carriage 122 and the second carriage 123 in the sub-scanning direction 135. In case of reading the image of the original placed on the document feeder 110, the image reading unit 120 temporarily stops the first carriage 122 and the second carriage 123 so as to correspond to an image reading position, and then reads the image of the original passing through the image reading position by the image sensor 125. The image sensor 125 creates the image data of the original corresponding to each color component of R (red), G (green), and B (blue) from the light image incident on the light receiving surface, for example.

The created image data can be printed out on the paper by the image forming unit 140. The image data also can be sent to other devices (not shown) from network interface via network.

The image forming unit 140 prints on the paper the image data obtained by the image reading unit 120 and the image data received from the other device (not shown) connected with the network via network interface not illustrated.

Figure 2:
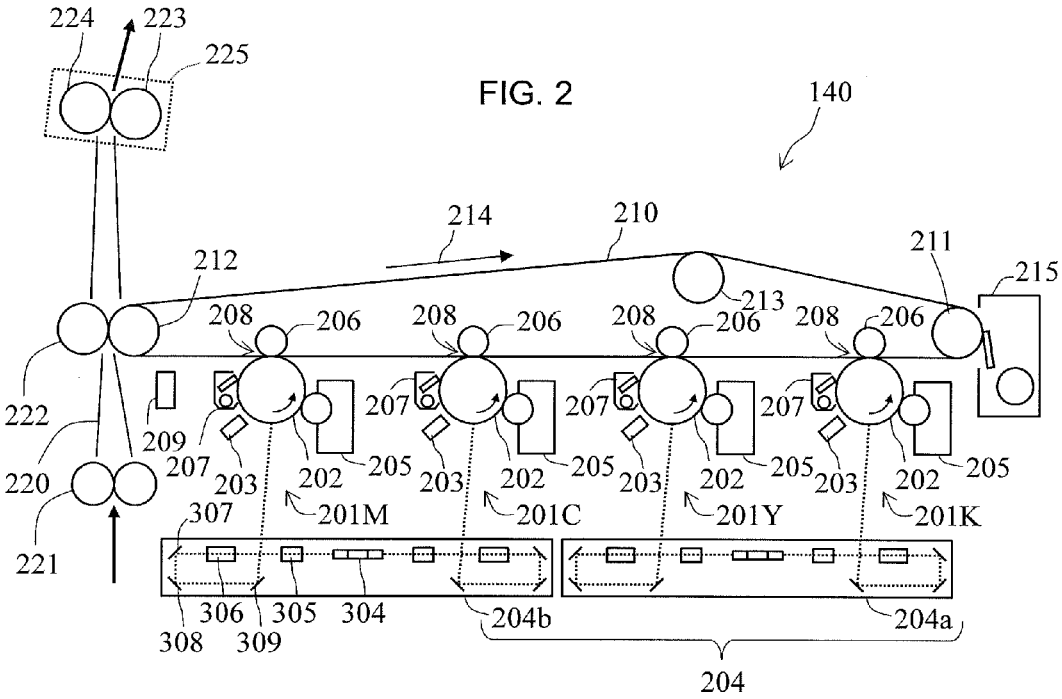
FIG. 2 is a schematic view showing a structure of an image forming unit of a multifunction peripheral in accordance with an embodiment of the present disclosure.

FIG. 2 is a schematic view showing a structure of the image forming unit 140. The image forming unit 140 is a tandem electrographic.

As shown in FIG. 2, the image forming unit 140 includes an endless transfer belt (a transfer unit) 210 and image forming units 201C, 201M, 201Y, and 201K that are disposed along the transfer belt 210 and form individual toner images in respective CMYK colors. The transfer belt 210 is wound by a driving roller 211 and driven rollers 212 and 213. The driven roller 213 is energized from the inside of the transfer belt 210 to the outside, and gives the tension to the transfer belt 210. The transfer belt 210 rotates in an arrow direction 214 by the driving of the driving roller 211.

Each of image forming units 201C, 201M, 201Y, and 201K is provided with a photosensitive drum 202 that is an image carrier. The photosensitive drum 202 rotates at a fixed speed in one direction. Around the photosensitive drum 202, a charging unit 203, a developing unit 205, a transfer roller 206, and a cleaning unit 207 are disposed in order from the upstream side of the rotation direction. And, an exposing unit 204 is disposed below the respective image forming units 201C, 201M, 201Y and 201K.

The charging unit 203 uniformly electrifies a surface (an image carrying surface) of the photosensitive drum 202. The exposing unit 204 irradiates the surface of the uniformly electrified photosensitive drum 202 with the light beam corresponding to the image data, the light beam going between the charging unit 203 and the developing unit 205 in each image forming unit 201C, 201M, 201Y and 201K, and then forms an electric latent image on the photosensitive drum 202. The developing unit 205 sticks the toner to the electric latent image, and forms a toner image on the photosensitive drum 202. The toner image is transferred to the transfer belt 210 at a first transfer portion 208 between the transfer roller 206 and the photosensitive drum 202. The cleaning unit 207 removes the toner remained on the surface of the photosensitive drum 202 after the transfer processing by the transfer roller 206.

The image forming unit in each color is not limited in particular, but it is configured in the present embodiment so as to be arranged in order of the image forming unit 201K, 201Y, 201C and 201M from the upstream side of the rotation direction of the transfer belt 210. Each image forming unit transfers the toner image in each color onto the transfer belt 210 in this order. The toner images in respective color are overlaid in order on the transfer belt 210 by controlling the transfer timing of the toner images in every color. As a result, the color toner image is formed on the transfer belt 210. Besides, the color image in RGB form is converted to the color image in CMYK form, and the image data in each color is inputted to the exposing unit 204 respectively.

The exposing unit 204 is composed of an exposing unit 204*a* for emitting light beam corresponding to the image forming units 201K and 201Y and an image forming unit 204*b* for emitting light beam corresponding to the image forming units 201C and 201M. The exposing unit 204*a* has the same structure as the exposing unit 204*b*. The structure of the exposing units 204*a* and 204*b* will be explained later.

On the downstream side of the image forming unit 201M and on the upstream side of a second transfer portion (between the transfer belt 210 and a second transfer roller 222), there is a density sensor 209 for detecting the density of the toner image formed on the transfer belt 210. The density sensor 209 is composed of a reflective type photo sensor provided with a light emitting unit and a light receiving unit, both units are on one side, and detects the density of the toner image, the density corresponding to the intensity of the light emitted from the light emitting unit and incident on the light receiving unit.

In the embodiment, the density sensor 209 is disposed on both ends of the width direction of the transfer belt 210, and it is also used to the density calibration for the image forming units 201C, 201M, 201Y and 201K. In the density calibration, each image forming unit 201C, 201M, 201Y and 201K forms a rectangular patch, for example, at a position facing to the density sensor on the transfer belt 210. And image forming conditions, that is the electric charging amount of the photosensitive drum 202 (the applied voltage of the charging unit), the light intensity of the exposure light, and the applied voltage of the transfer roller 206, are determined so that the density detected by the density sensor 209 be a predetermined density. The density calibration is executed whenever the image forming processing is executed a predetermined number of times, or whenever the specific time has lapsed, for example. Besides, since such calibration is a well-known art, the detailed explanation is not made here.

The image forming unit 140 feeds a paper from a manual paper feed tray 151 or paper feeding cassettes 152, 153, 154 (see FIG. 1) to the second transfer portion between the transfer belt 210 and the second transfer roller 222, through a conveyance path 220. The various size of paper can be placed on or accommodated in the manual paper feed tray 151 and the paper feeding cassettes 152, 153, and 154. The image forming unit 140 selects the paper specified by user or the paper detected automatically corresponding to a size of original, and then feeds the selected paper from the manual paper feed tray 151 or the paper feeding cassette 152, 153 or 154 by a conveyance roller. The fed paper is conveyed to the second transfer portion by the conveyance roller and a resist roller 221. The paper on which the toner image is transferred is conveyed to a fixing unit 225. The fixing unit 225 has a fixing roller 223 including a heater and a pressure roller 224, and the toner image is fixed on the paper by the heat and the pressure. The image forming unit 140 ejects the paper passing through the fixing unit 225 to a copy receiving tray 141 (see FIG. 1). After the second transfer processing, the toner remaining on the transfer belt 210 is removed by the cleaning unit 215 disposed on the downstream side of the second transfer portion and on the upstream side of the image forming unit 201K.

Figure 3:
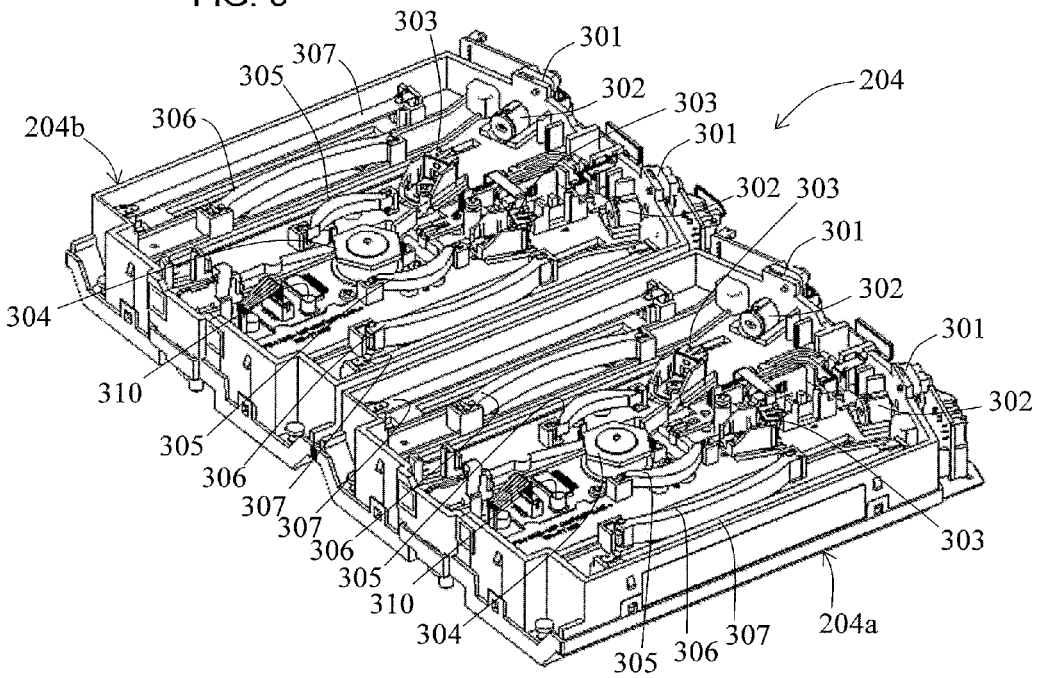
FIG. 3 is a perspective view showing a structure of an exposing unit of a multifunction peripheral in accordance with an embodiment of the present disclosure.

FIG. 3 is a schematic view showing a structure of the exposing unit 204 (exposing units 204*a* and 204*b*) provided to the multifunction peripheral 100. The respective exposing units 204*a* and 204*b* include two light sources, respective incident optical systems corresponding to the light sources, a rotary polyhedron (a polygon mirror), and two light emitting optical systems within a housing. Besides, regarding the optical systems of the exposing units 204*a* and 204*b*, the same optical parts are made of the same material.

The light source 301 is composed of a laser diode (a laser oscillator) implemented on a circuit board. The circuit board modulates the intensity of the light beam (the laser light) emitted from the laser diode according to the image signal inputted from the outside.

The incident optical system includes an optical unit 302 having a collimator lens and an aperture, and a cylindrical lens 303. The light beam emitted from the light source 301 is incident on the collimator lens of the optical unit 302. The collimator lens is composed of a cylindrical glass lens, and converts the light beam emitted from the laser diode to a parallel light beam that accords with the light axis of the collimator lens, and then outputs the converted light beam. The light beam passing through the optical unit 302 is incident on a reflective surface of the rotary polyhedron 304 through the cylindrical lens 303. Besides, the light emitting point of the laser diode is disposed on a focal point of the collimator lens.

The rotary polyhedron 304 includes the reflective surfaces for reflecting the light beam emitted from the light source 301, and functions as a deflector for scanning the light beam from the light source 301 in the main-scanning direction on the surfaces of the photosensitive drum 202, the surface to be scanned, by moving the reflective surface of the rotary polyhedron. In the embodiment, the rotary polyhedron 304 has a rotation shaft disposed in a vertical direction of the light beam incident on the surface of the photosensitive drum 202, and the rotation shaft is driven to rotate in one direction by the driving motor. The rotary polyhedron 304 has six hexagonal prism-shaped reflective surfaces in the same size disposed around the rotation shaft. In the exposing unit 204*a* (204*b*) here, the light beam emitted from the light source 301 is incident on a different surface of the rotary polyhedron 304. Besides, the cylindrical lens 303 forms a light image on the reflective surface of the rotary polyhedron 304 by converging the light beam on the width of the sub-scanning direction of the light beam.

The light beam deflected by the rotation of the rotary polyhedron 304 is incident on the light emitting optical system. In this embodiment, the light emitting optical system includes a f-θ lens composed of two acrylic lenses 305 and 306, and three mirrors 307, 308, 309 (see FIG. 2). The light emitting optical system forms the light image in spot on the surface of the photosensitive drum 202, in the state that the scanning speed on the photosensitive drum 202 is approximately the same. The f-θ lens corresponding to each light beam is disposed in opposite each other across the rotary polyhedron 304.

The driving circuit for driving the rotary polyhedron 304 is configured on the circuit board, and a thermistor that is a temperature detecting unit 310 is disposed on the circuit board.

In the exposing unit 204*a* configured as above, the scanning directions of the light beam corresponding to the image forming unit 201K and the light beam corresponding to the image forming unit 201Y are opposite in each other. In FIG. 3, for instance, where the rotary polyhedron 304 rotates clockwise, the light beam corresponding to the image forming unit 201K has the scanning direction going from a side on which the light source 301 is disposed to a side on which the light source 301 is not disposed. The light beam corresponding to the image forming unit 201Y has the scanning direction going from the side on which the light source 301 is not disposed to the side on which the light source 301 is disposed. Likewise, in the exposing unit 204*b*, where the rotary polyhedron 304 rotates clockwise, the light beam corresponding to the image forming unit 201C has the scanning direction going from the side on which the light source 301 is disposed to the side on which the light source 301 is not disposed. The light beam corresponding to the image forming unit 201M has the scanning direction going from a side on which the light source 301 is not disposed to a side on which the light source 301 is disposed.

In the exposing unit 204 as configured above, when the temperature change occurs due to the heat or the like generated in the multifunction peripheral 100, there is a fluctuation of the optical properties of the optical parts, such as the mirror or lens constituting the incident optical system and the light emitting optical system. Due to the fluctuation of the optical properties of the optical parts, the deviation occurs in the light path of the light beam. The deviation of the light path appears notably as the color misregistration in the main-scanning direction, and there is a possibility that the distortion occurs in the housing of the exposing unit 204. When the housing of the exposing unit 204 is distorted, it changes the positions of the optical parts like the lens and the mirror constituting the incident optical system and the light emitting optical system. Resulting from the position change of the optical parts, the deviation occurs in the light path of the light beam. Such deviation of the light path appears notably as the misregistration in the sub-scanning direction.

Figure 4:
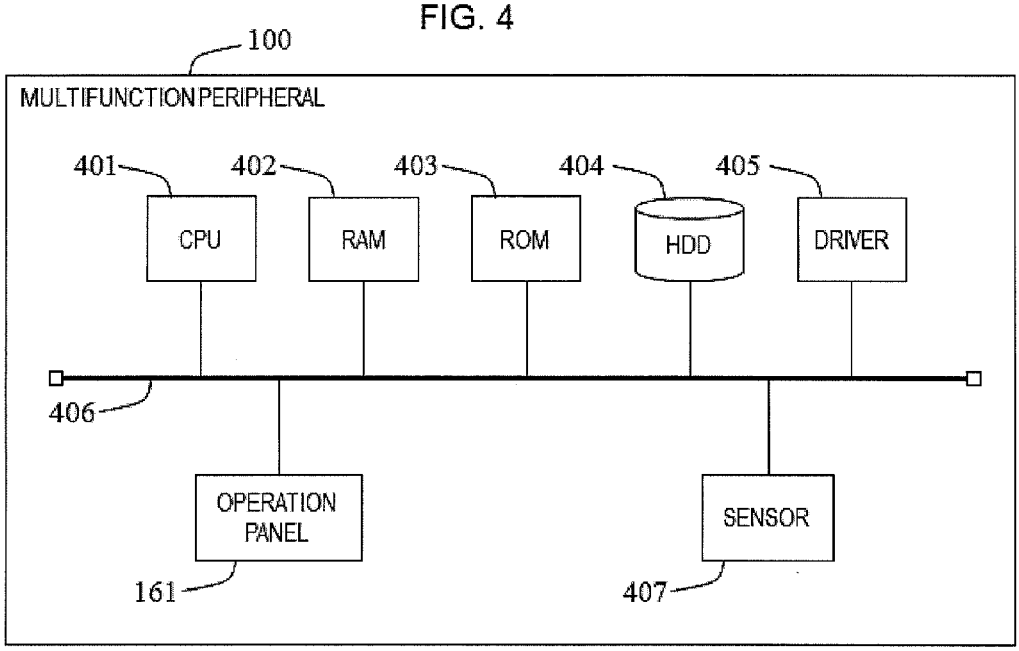
FIG. 4 is a diagram showing a hardware structure of a multifunction peripheral in accordance with an embodiment of the present disclosure.

FIG. 4 is a hardware block diagram of control system for the multifunction peripheral. In the multifunction peripheral 100 in this embodiment, CPU (Central Processing Unit) 401, RAM (Random Access Memory) 402, ROM (Read Only Memory) 403, HDD (Hard Disk Drive) 404, and a driver 405 corresponding to driving units of the document feeder 110, the image reading unit 120, and the image forming unit 140, are connected via an internal path 406. ROM 403 and HDD 404 stores programs, and CPU 401 controls the multifunction peripheral 100 according to instructions from the control programs. For instance, CPU 401 uses RAM 402 as a working area, and sends and receives the instruction and the data from and to the driver 405, whereby the working of each driving unit can be controlled. HDD 404 is also used for storing the image data obtained from the image reading unit 120 and the image data received from the outside devise via network interface.

The internal path 406 is also connected with the operation panel 161 and various sensors 407. The operation panel 161 receives the user operation, and supplies a signal based on the operation to CPU 401. The operation panel 161 displays an operation screen on a display provided to the operation panel 161 according to the control signal from CPU 401. The sensor 407 includes various kinds of sensors, such as an open and shut detecting sensor for detecting the opening and the shutting of the platen cover 102, an original detecting sensor for detecting an original on the original plate 103, a temperature detecting sensor for detecting the temperature of the fixing unit 225, a paper detecting sensor for detecting the paper or the original to be conveyed, and so on. CPU 401 executes the programs stored in ROM 403, whereby the following means (functional blocks) can be realized and it is possible to control the working of each means according to the signals from these sensors.

Figure 5:
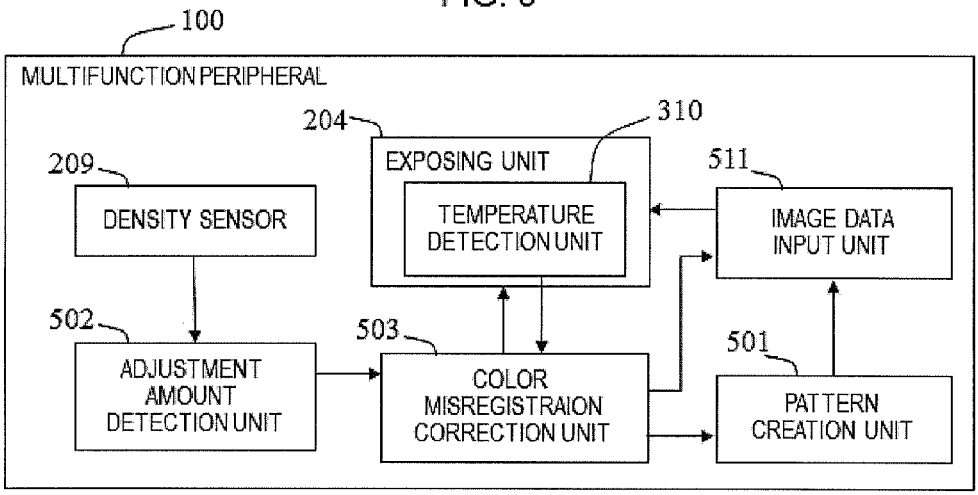
FIG. 5 is a functional block diagram showing a multifunction peripheral in accordance with an embodiment of the present disclosure.

FIG. 5 is a functional block diagram of the multifunction peripheral in the embodiment. As shown in FIG. 5, the multifunction peripheral 100 in the present embodiment includes a pattern forming unit 501, an adjustment amount detection unit 502 and a color misregistration correction unit 503.

The pattern forming unit 501 forms a color misregistration detection pattern for detecting the color misregistration on the transfer belt 210 according to a toner image in reference color formed by a light beam emitted from an exposing unit (the exposing unit 204*a*, for example) and a toner image in adjustment color formed by the other light beam emitted from the other exposing unit (the exposing unit 204*b*, for example). Here, the scanning directions of the respective light beams emitted from both the exposing units are different each other. For instance, when the reference color is black, the adjustment color is magenta.

Figure 6:
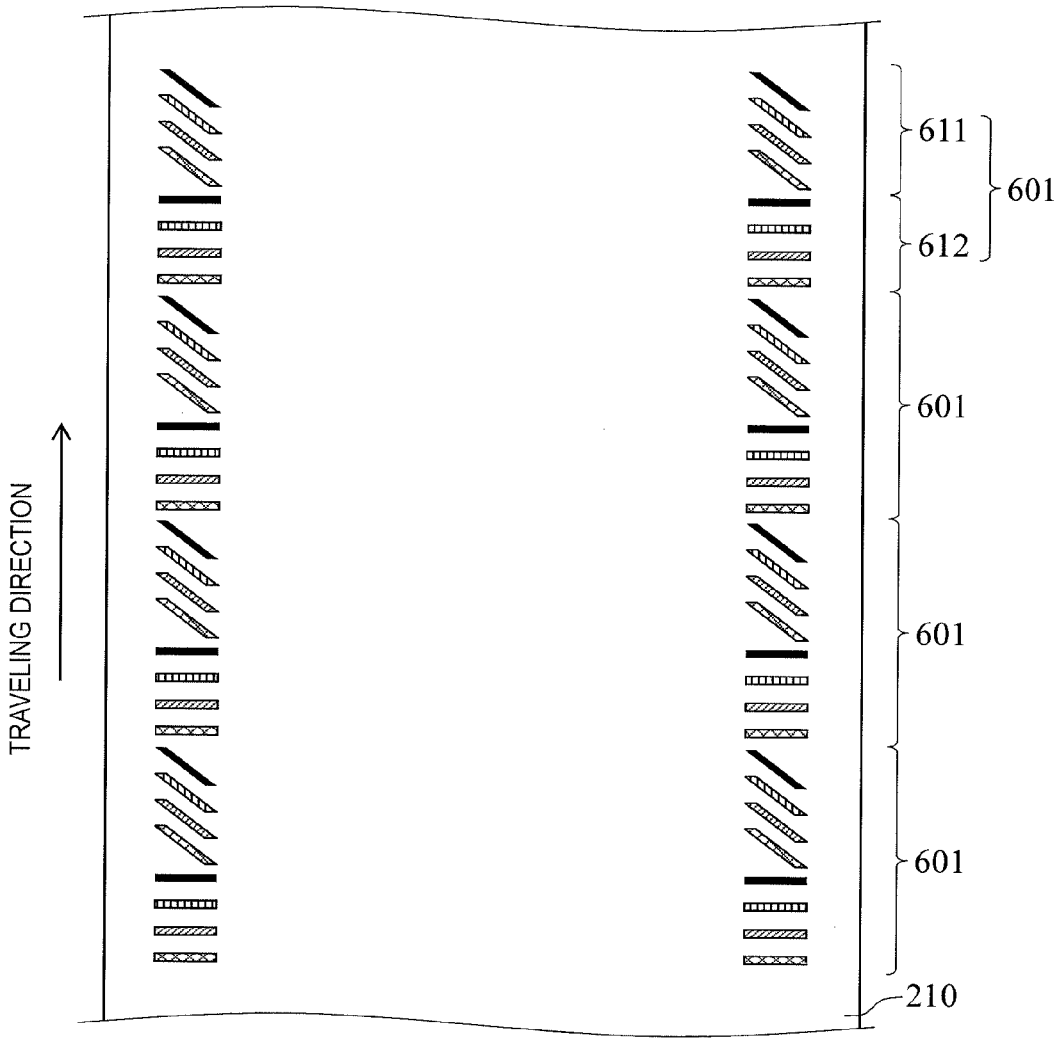
FIG. 6 is a diagram showing a color misregistration detection pattern in the conventional arts.
Figure 7:
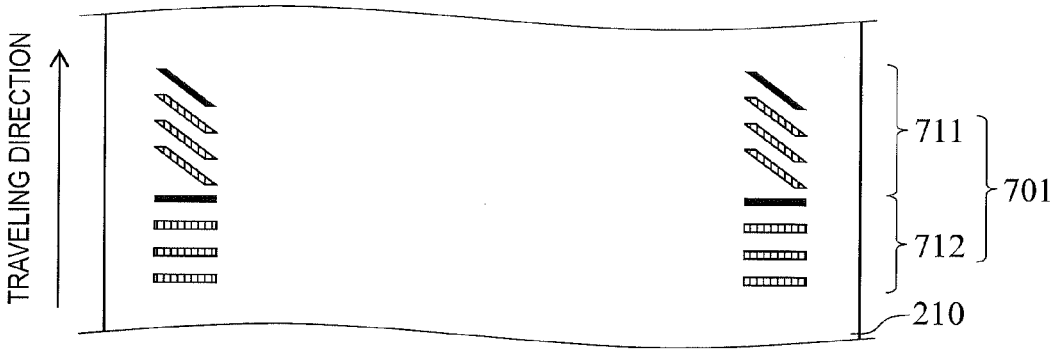
FIG. 7 is a diagram showing a misregistration detection pattern formed by a multifunction peripheral in accordance with an embodiment of the present disclosure.

The color misregistration detection pattern is explained here. FIG. 6 shows an example of a conventional color misregistration detection pattern, and FIG. 7 shows an example of the color misregistration detection pattern created by the pattern creation unit 501 in the present disclosure.

As shown in FIG. 6, the conventional color misregistration detection pattern 601 is formed on the both ends of the width direction (hereinafter referred to "the main-scanning direction") of the transfer belt 210 in the state of facing the density sensor 209. The color misregistration detection pattern 601 is composed of a band-shaped pattern group 611 inclined by 45 degree with respect to both the main-scanning direction and a traveling direction of the transfer belt 210 (hereinafter referred to "the sub-scanning direction"), and a band-shaped pattern group 612 disposed along the main-scanning direction. The widths in the main-scanning direction of the band-shaped pattern groups 611 and 612 are designed to be the same length. The band-shaped pattern groups 611 and 612 include four band-shaped patterns in the same shape created by the respective image forming units 201C, 201M, 201Y and 201K. In the example, the band-shaped patterns are disposed in order of K (black), M (magenta), C (cyan), and Y (yellow) from the downstream side of the transfer belt 210. Regarding the band-shaped pattern groups 611 and 612, the distances between the band-shaped patterns in each color are designed to be the same distance.

The density sensor 209 measures the above-mentioned color misregistration patterns, and obtains the density change at a specific position in the main-scanning direction of the color misregistration detection pattern 601 (at the position facing the density sensor 209). The positions of the respective band-shaped patterns can be detected on the basis of the density change.

Regarding the color misregistration detection patterns 601, when the relative color misregistration does not occurs among the patterns created in each color, each distance between the band-shaped patterns in the same color included in the band-shaped pattern groups 611 and 612 (a distance between the centers of the band-shaped patterns, for example) becomes the same in every color, and the distances between the band-shaped patterns in each color included in the band-shaped pattern groups 612 (a distance between the centers of the band-shaped patterns) become the same. Specifically, the distances between the band-shaped pattern in each color and the band-shaped pattern on the most downstream side become integral multiple of the distance between the neighboring band-shaped patterns.

Where the distances between the band-shaped patterns in each color included in the band-shaped pattern groups 612 are the same but when the distances between the band-shaped patterns in the same color included in the band-shaped pattern groups 611 and 612 are not the same in a specific color, the misregistration of the pattern in the specific color occurs in the main-scanning direction. In such case, the direction and distance of the color misregistration can be detected by the large/small relation and difference of the distance between the band-shaped pattern in the specific color and the band-shaped patter in the other color (black, for example) that is a reference color. In addition, where the distances between the band-shaped patterns in the same color included in the band-shaped pattern groups 611 and 612 are the same in every color but when the respective distances between the band-shaped patterns in each color included in the band-shaped pattern group 612 are not the same, the color misregistration of the pattern in a specific color occurs in the sub-scanning direction. In such case, the direction and distance of the color misregistration can be detected by the distance between the band-shaped pattern in the specific color and the band-shaped pattern in the other color (black, for example) that is the reference color.

Besides, since the measurement is executed repeatedly in order to improve the measurement accuracy of the distances between the band-shaped patterns in the embodiment, the color misregistration detection patterns 601 are created repeatedly in the sub-scanning direction.

On the other hand, the color misregistration detection pattern 701 created by the pattern creation unit 501 is composed of two of the pattern in a reference color and the pattern in an adjustment color, as shown in FIG. 7. The color misregistration detection pattern 701 is formed on the both ends of the main-scanning direction of the transfer belt 210 so as to face the density sensor 209, in the same manner as the conventional color misregistration detection pattern 601.

The color misregistration detection pattern 701 is composed of a band-shaped pattern group 711 inclined by 45 degree with respect to the main-scanning direction and the sub-scanning direction, and the band-shaped pattern group 712 disposed along the main-scanning direction. The widths in the main-scanning direction of the band-shaped pattern groups 711 and 712 are designed to be the same length. The band-shaped pattern groups 711 and 712 include four band-shaped patterns in the same shape, those patterns being created by the image forming unit 201K for black that is the reference color and the image forming unit 201M for magenta that is the adjustment color. In the example, the band-shaped pattern on the most downstream side of the band-shaped pattern groups 711 and 712 is created in black that is the reference color, and the other three band-shaped patterns are created in magenta that is the adjustment color. Regarding the band-shaped pattern groups 711 and 712, the distances between the band-shaped patterns are designed to be the same in each other. In the embodiment, since the measurement is executed repeatedly so as to improve the measurement accuracy of the distances between the band-shaped patterns, a plurality of the band-shaped patterns in the adjustment color is created.

The relative color misregistration direction and distance between the reference color and the adjustment color can be detected by means of the above-mentioned color misregistration detection pattern 701, in the same manner as described about the conventional color misregistration detection patterns 601 in four colors.

In the exposing unit 204 configured as above, when the temperatures of the exposing units 204*a* and 204*b* are the same, the optical properties and the positions of the optical parts in the exposing units 204*a* and 204*b* change to the same degree in both the main-scanning direction and the sub-scanning direction. Therefore, light paths of the light beams of the same main-scanning direction (for example, the light beam corresponding to the image forming unit 201K and the light beam corresponding to the image forming unit 201C) deviates to the same degree and in the same direction with respect to the state before the temperature change. Accordingly, the color misregistration becomes very small between the toner images corresponding to the light beams of the same scanning direction.

On the other hand, respective light paths of the light beams having the scanning directions in opposite to each other (for instance, the light beam corresponding to the image forming unit 201K and the light beam corresponding to the image forming unit 201M) deviates to the same degree in the directions in opposite to each other with respect to the state before the temperature change. Accordingly, the color misregistration becomes large between the toner images corresponding to the light beams having the scanning directions in opposite to each other.

As understood from the above description, when the temperatures of the exposing units 204*a* and 204*b* are the same, the deviation amount (the color misregistration amount) between the light beams having the scanning directions in opposite to each other is detected, and then the timing of emitting the light beams is corrected so as to eliminate the misregistration, so that it is possible to eliminate the color misregistration in all colors. Specifically, the color misregistration amount of the adjustment color (magenta) with respect to the reference color (black) is detected by the color misregistration detection pattern 701, and the light emitting timings of the light beam corresponding to magenta and the light beam corresponding to yellow are corrected on the basis of the detected color misregistration amounts, so that the color misregistration in all colors can be eliminated. When the temperatures of the exposing units 204*a* and 204*b* are not the same, it is preferred to apply the temperature correction to the light beams corresponding to colors except for the reference color and the adjustment color. The temperature correction will be explained later.

The adjustment amount detection unit 502 detects a color misregistration adjustment amount according to the color misregistration detection pattern created on the transfer belt 210. In the embodiment, the adjustment amount detection unit 502 obtains the above-mentioned color misregistration amount in the main-scanning direction (the direction and the distance) and the above-mentioned color misregistration amount in the sub-scanning direction (the direction and the distance) as the color misregistration adjustment amount.

The color misregistration correction unit 503 moves the image forming positions, on which the toner image in each color is formed by the light beam having the scanning direction in opposite to the light beam corresponding to the reference color, the color misregistration adjustment amount detected by the adjustment amount detection unit 502, on the basis of the image forming position of the reference color. The image forming position can be moved by adjusting the light emitting timing of the light beam from the light source 301, for example. As described above, where the reference color is black, the light beams having the scanning direction in opposite to the light beam corresponding to the reference color are the light beam corresponding to magenta and the light beam corresponding to yellow.

The image data to be inputted to the exposing unit 204 is not limited in particular, but it is configured in the multifunction peripheral 100 so as to be created by an image data input unit 511. The image data input unit 511 converts the image data in RGB form to the image data in CMYK form, and retains the image data in each color. In the embodiment, RAM 402 functions as the image data retaining area for the image data input unit 511. The image data input unit 511 inputs the image data in each color to the exposing unit 204.

Figure 8:
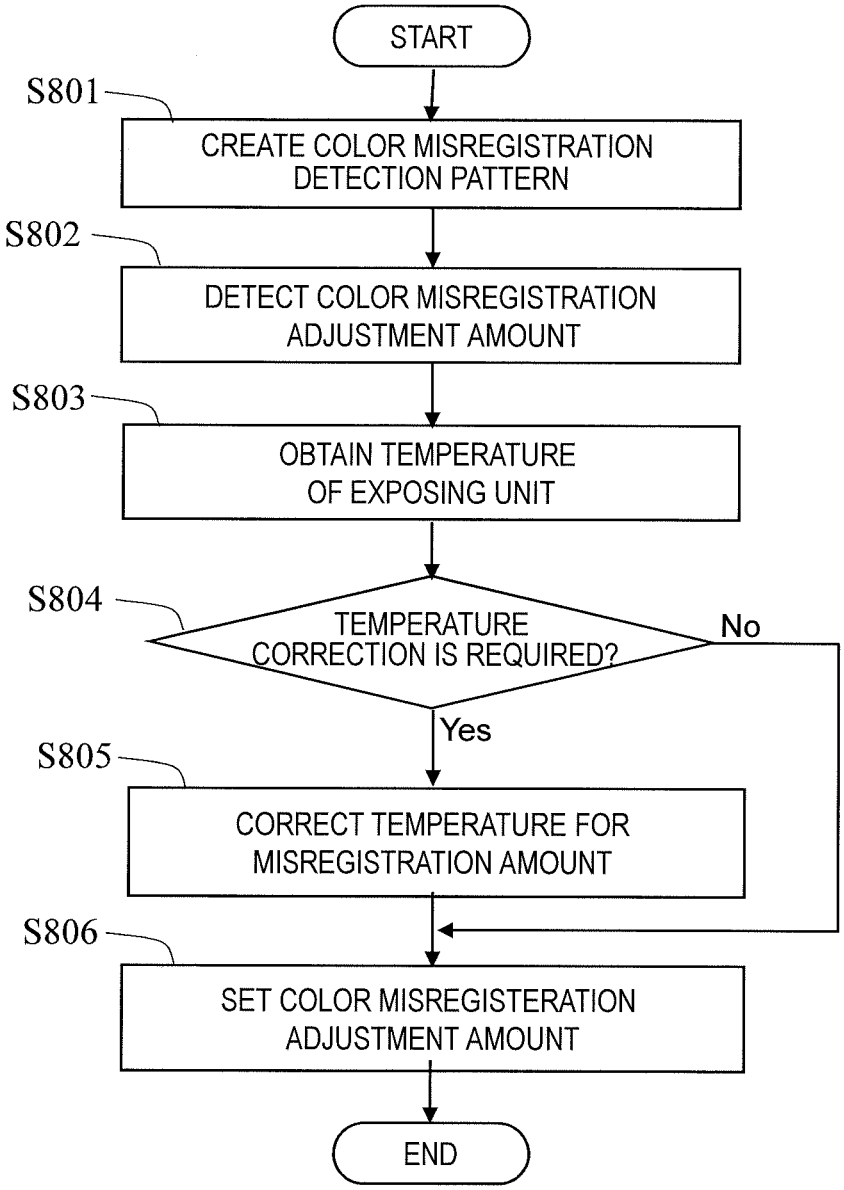
FIG. 8 is a flowchart showing misregistration correction steps in accordance with an embodiment of the present disclosure.

FIG. 8 is a flowchart showing an example of the color misregistration correction steps executed by the multifunction peripheral 100. The step starts when the predetermined timing for executing the color misregistration correction has come, like in a predetermined time cycle or when a predetermined time has passed after the prior color misregistration correction.

When the step begins, the pattern creation unit 501 creates the color misregistration detection pattern 701, as shown in FIG. 7, on the transfer belt 210 through the image data input unit 511 and the exposing unit 204 (step S801). At this time, the adjustment amount detection unit 502 obtains, as a color misregistration adjustment amount, the color misregistration amount (direction and distance) in the main-scanning direction of black (the reference color) and magenta (the adjustment color) and the color misregistration amount (direction and distance) in the sub-scanning direction according to the density information obtained by the density sensor 209 (step S802). After obtaining the color misregistration adjustment amount, the adjustment amount detection unit 502 inputs the obtained color misregistration adjustment amount to the color misregistration correction unit 503.

Upon receipt of the input, the color misregistration correction unit 503 obtains the temperatures of the exposing units 204*a* and 204*b* from the temperature detection units 310 provided to the exposing units 204*a* and 204*b* (step S803). The color misregistration correction unit 503 determines, according to the obtained temperatures of the exposing units 204*a* and 204*b*, whether the temperature correction is required or not (step S804).

At the determination, when the temperatures of the exposing units 204*a* and 204*b* are the same, the color misregistration correction unit 503 determines that the temperature correction is not required (step S804 No). Here, "the temperatures are the same" includes a case where the temperatures are perfectly identical with each other and a case where the temperatures are considered to be the same substantially. When it is determined that the temperature correction is not required, the color misregistration correction unit 503 executes the color misregistration correction according to the color misregistration adjustment amount inputted from the adjustment amount detection unit 502 (step S806). Specifically, the image forming positions, on which the toner images are formed by the light beams corresponding respective to magenta and yellow, are moved the color misregistration adjustment amount on the basis of the image forming position of the toner image by the light beam corresponding to black. The method of the color misregistration correction is not limited in particular, but it is configured in the present embodiment so as to set the color misregistration adjustment amount, that is the correction value, to the image data input unit 511 for inputting the exposure image data to the exposing unit 204. In such case, the image data input unit 511 adjusts the light emitting timings of the light beams according to the color misregistration adjustment amounts set as above, and changes the start timing of forming the image. Besides, the image forming position of each toner image can be moved relatively as long as the image forming positions are not restricted in particular. That is to say, it is possible to move both the toner image in the reference color and the toner image corresponding to the light beam having the same scanning direction as the light beam corresponding to the reference color.

When the temperatures of the exposing units 204*a* and 204*b* are not the same, the color misregistration correction unit 503 determines that the temperature correction is required (step S804 Yes). When it is determined that the temperature correction is required, the color misregistration correction unit 503 executes the temperature correction in order to move the image forming positions of the toner images in respective colors formed by the light beams (yellow and cyan) not used to create the color misregistration detection pattern 701 on the basis of the image forming position of the toner image in the reference color (step S805).

Figure 9A:
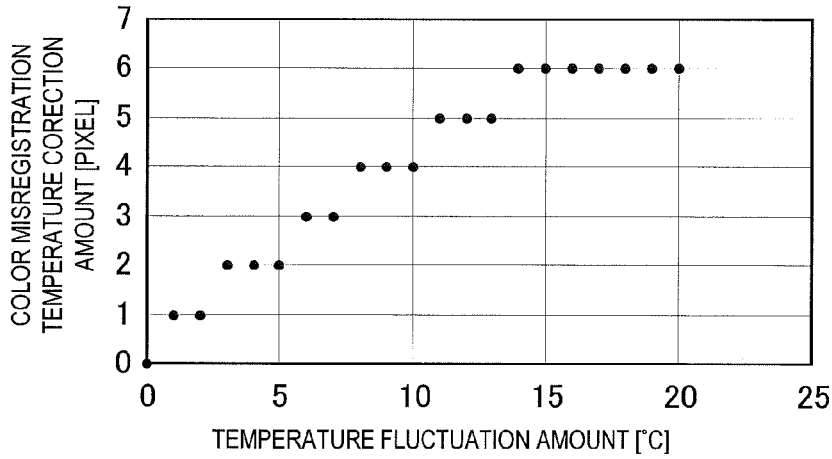
FIG. 9A, FIG. 9B and FIG. 9C are graphs showing the temperature dependency of the color misregistration in accordance with an embodiment of the present disclosure.
Figure 9B:
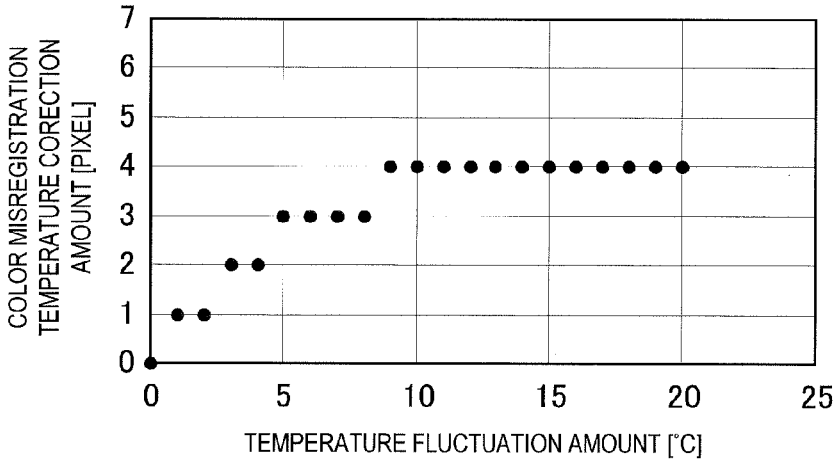
Figure 9C:
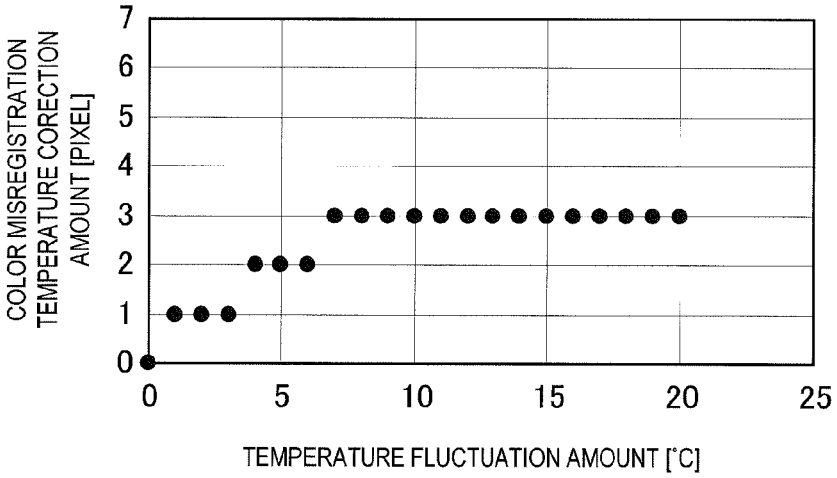

FIG. 9A to FIG. 9C are graphs showing the temperature dependency of the temperature correction amount for the color misregistration adjustment amount in the sub-scanning direction detected by the adjustment amount detection unit 502 (hereinafter referred to "color misregistration temperature correction amount"). FIG. 9A is the graph showing the temperature dependency of the color misregistration temperature correction amount in the sub-scanning direction at a specific temperature when the surrounding temperature is comparatively low. FIG. 9B is the graph showing the temperature dependency of the color misregistration temperature correction amount in the sub-scanning direction when the surrounding temperature is a normal temperature. FIG. 9C is the graph showing the temperature dependency of the color misregistration temperature correction amount in the sub-scanning direction at the other specific temperature when the surrounding temperature is comparatively high. With reference to FIGS. 9A to 9C, a horizontal axis corresponds to a temperature fluctuation amount of the exposing unit 204*a* (204*b*), a vertical axis corresponds to the color misregistration temperature correction amount. Besides, FIGS. 9A to 9C indicate only the cases where the temperature rises, for convenience sake. The following explanation relates to the color misregistration temperature correction in the sub-scanning direction, and the color misregistration temperature correction in the main-scanning direction can be executed in the same manner.

As understood from FIG. 9A to FIG. 9C, when the surrounding temperature is different even if the temperature fluctuation amount is the same, the color misregistration temperature correction amount in the sub-scanning direction is different. The correspondence relation shown in FIG. 9A indicates that, when the temperature fluctuation amount is 15° C., for example, the correction amount of six pixels is required at the temperature fluctuation. On the other hand, the correspondence relation shown in FIG. 9B indicates that, when the temperature fluctuation amount is 15° C., the correction amount of four pixels is required due to the temperature fluctuation. In addition, the correspondence relation shown in FIG. 9C indicates that, when the temperature fluctuation amount is 15° C., the correction amount of three pixels is required due to the temperature fluctuation. In the present embodiment, the color misregistration correction unit 503 has stored in advance, for every surrounding temperature, the correspondence relation of the temperature fluctuation amount and the color misregistration temperature correction amount as shown FIG. 9A to FIG. 9C. The color misregistration correction unit 503 executes the above-mentioned temperature correction by means of the correspondence relation corresponding to the obtained surrounding temperature. Besides, the method of obtaining the surrounding temperature is not limited in particular, it is configured in the present embodiment so as to obtain the surrounding temperature by a temperature sensor disposed at an arbitrary position not affected by the temperature rise caused by the working of the image forming unit 140 in the multifunction peripheral 100.

For instance, if it is assumed that the surrounding temperature is a normal temperature and the temperature fluctuation amount of the exposing unit 204*b* is +10° C., the color misregistration temperature correction amount is four pixels. At this time, if the temperature fluctuation amount of the exposing unit 204*a* is +5° C., the color misregistration temperature correction amount corresponding to the temperature fluctuation amount +5° C. is three pixels. Under such conditions, magenta is deviating for four pixels due to the temperature fluctuation as compared with a case where there is no temperature fluctuation, and yellow is deviating for three pixels due to the temperature fluctuation as compared with a case where there is no temperature fluctuation. Since the color misregistration adjustment amount inputted from the adjustment amount detection unit 502 includes four pixels of the deviation amount of magenta, when yellow is shifted for four pixel as well as magenta, yellow and magenta are not aligned. Accordingly, the color misregistration adjustment amount of yellow should not be identified with the deviation amount of magenta, but it should be only one pixel, that is, 4 pixels−3 pixels=1 pixel, so that the color misregistration caused by the temperature difference between the exposing units 204*a* and 204*b* can be eliminated. Such temperature correction is executed on the light beam corresponding to cyan, on the basis of black.

After the above-mentioned temperature correction, the color misregistration correction unit 503 executes the color misregistration correction, namely, the image forming position of the toner image by the light beam corresponding to magenta, the image forming position of the toner image by the light beam corresponding to yellow, and the image forming position of the toner image by the light beam corresponding to cyan are moved the color misregistration adjustment amount on the basis of the image forming position of the toner image by the light beam corresponding to black (step S806).

Figure 10A:
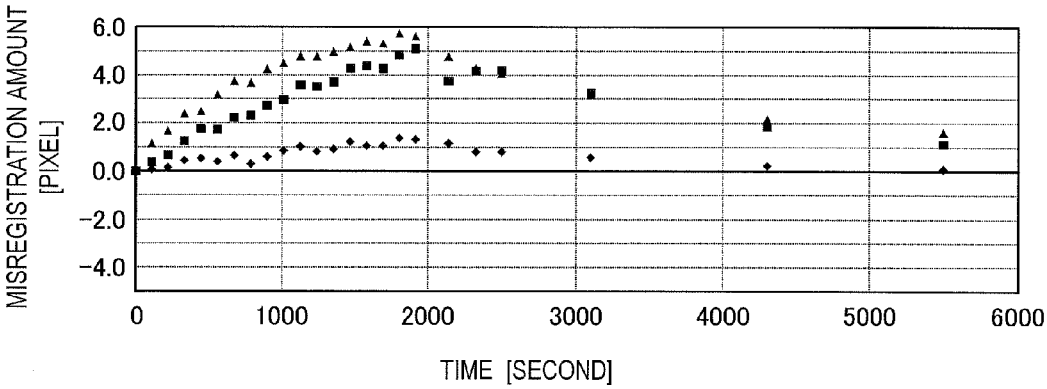
FIG. 10A and FIG. 10B are graphs showing an effect of the color misregistration correction in accordance with an embodiment of the present disclosure.
Figure 10B:
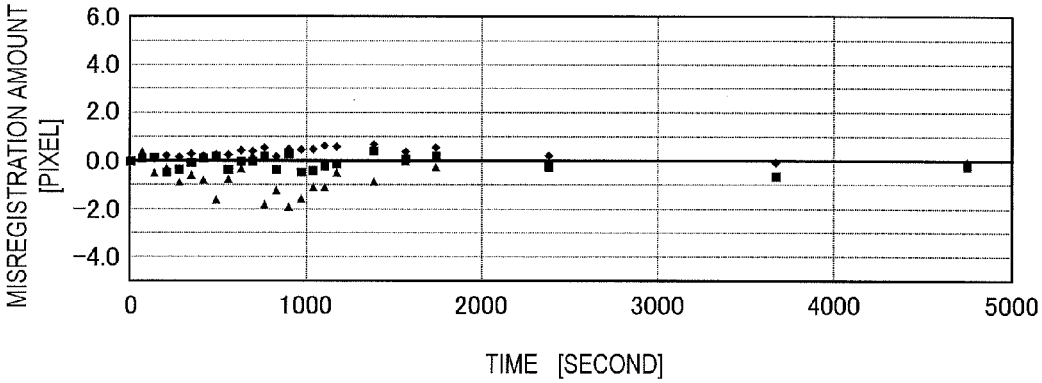
Figure 11A:
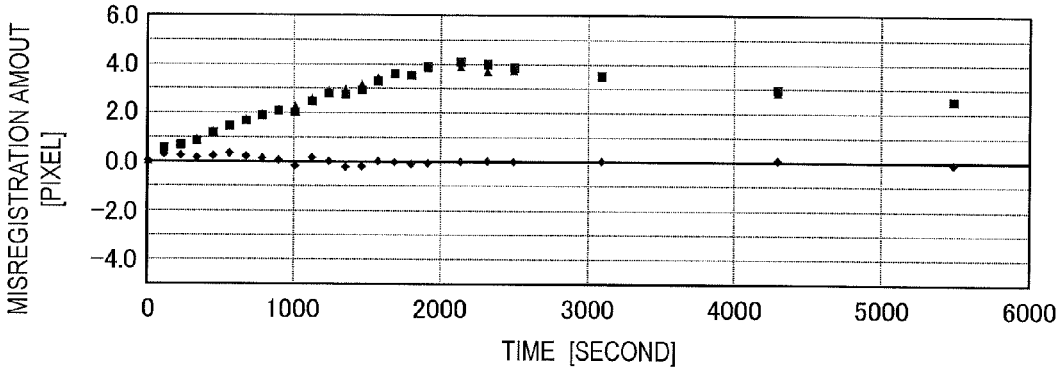
FIG. 11A and FIG. 11B are graphs showing an effect of the misregistration correction in accordance with an embodiment of the present disclosure.
Figure 11B:
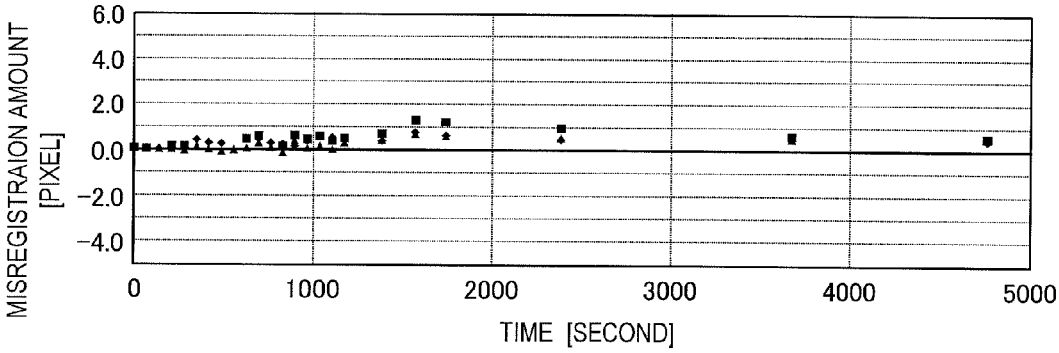

FIG. 10A, FIG. 10B, FIG. 11A and FIG. 11B show the effect in a case applying the color misregistration correction described above. FIG. 10A and FIG. 11A indicate the color misregistration amount when the above-mentioned color misregistration correction is not applied. FIG. 10B and FIG. 11B indicate the color misregistration amount when the above-mentioned color misregistration correction is applied. FIG. 10A and FIG. 10B indicate the color misregistration amount in the sub-scanning direction. FIG. 11A and FIG. 11B indicate the color misregistration amount in the main-scanning direction. In each graph, the horizontal axis corresponds to the elapsed time after the color misregistration correction using the color misregistration detection pattern in four colors 601, and the vertical axis corresponds to the color misregistration amount. Besides, magenta, yellow, and cyan are expressed in each graph by shapes; a black square, a solid triangle, and a black diamond.

As understood from FIG. 10A and FIG. 11A, there is no misregistration when the color misregistration correction is executed by the color misregistration detection pattern in four colors 601, but after that, a large color misregistration occurs. In particular, the color misregistration of magenta and yellow, of which the light beams have the scanning directions opposite to black, is large. On the contrary, in FIG. 10B and FIG. 11B, since the color misregistration correction is executed by the color misregistration detection pattern in two colors 701, it is perceived that the color misregistration can be suppressed appropriately.

As described above, since the multifunction peripheral 100 executes the color misregistration correction by the color misregistration detection pattern 701 including two of the reference color and the adjustment color, the color misregistration correction can be executed in a short time. In addition, as understood from FIG. 6 and FIG. 7, the toner amount consumed by the color misregistration correction becomes very small as compared with the conventional method. It is possible to reduce the load of the cleaning unit for cleaning the surface of the transfer unit. Since the color misregistration correction with the color misregistration detection pattern 701 is a very simplified method, the correction accuracy becomes lower than the correction with the color misregistration detection pattern 601 in four colors. Therefore, where the color misregistration correction with only the color misregistration detection pattern 701 is executed for a long time, there is a possibility that the effect of suppressing the color misregistration is reduced. It is desired to properly use the color misregistration correction for all colors together with the method in the present disclosure, namely, it is preferable to execute the color misregistration correction by the color misregistration detection pattern 601 using four colors at a predetermined timing.

The multifunction peripheral 100 in the present disclosure is configured to execute the temperature correction, so that the occurrence of the color misregistration can be suppressed more than ever, and the image quality can be more improved.

The above-mentioned embodiments do not limit the technical scope of the present disclosure, and other modification and application other than the described embodiments may be made within the scope of the present disclosure. For instance, the above embodiments describe the configuration for executing the temperature correction as the preferable embodiments, however, where the temperature difference between the exposing units 204*a* and 204*b* hardly occurs, the color misregistration can be suppressed without the temperature correction.

Regarding the flowchart shown in FIG. 8, the order of respective steps can be changed properly within the range providing with the equivalent working. For instance, in FIG. 8, it is determined whether or not the temperature correction is required by comparing the temperatures of the exposing units 204*a* and 204*b*, but the temperature correction may be always executed without such determination. In this case, when the temperature correction is not required, the color misregistration temperature correction amount becomes zero, whereby it is possible to obtain the same effect.

The above embodiments refer to the configuration wherein the light beam in black emitted from the exposing unit 204*a* is defined as the reference color, and the light beam in magenta emitted from the exposing unit 204*b* is defined as the adjustment color. The configuration is not limited to this, but the light beam of the reference color and the light beam of the adjustment color may be emitted from the same exposing unit. For instance, it may be configured that the light beam in black is defined as the reference color and the light beam in yellow is defined as the adjustment color. Otherwise, it may define the light beam in cyan as the reference color and the light beam in magenta as the adjustment color.

In addition, the present disclosure is materialized in the above embodiments as the digital multifunction peripheral, but the present disclosure may be applied to any arbitrary image forming unit other than the digital multifunction peripheral, such as the printer, the copying machine, and the like.

According to the present disclosure, the color misregistration in each color can be corrected in a short time, so that it is possible to suppress the reduction of the performance caused by the color misregistration correction, and the present disclosure is useful to the image forming apparatus.

What is claimed is:

1. An image forming apparatus configured to form an image by overlaying images formed separately for every color, the apparatus comprising;

plural-exposing units each configured to emit a pair of light beams that are deflected to reverse scanning directions from each other by a rotary polyhedron;

image carriers disposed for every color and corresponding to respective light beams emitted from the plural exposing units, and each image carrier having an image carrier surface on which the corresponding light beam forms a latent image;

developing units configured to form toner images corresponding to the latent images by sticking the toner onto the latent images on the image carrying surfaces;

a transfer unit configured to transfer thereon the toner images carried by the image carrying surfaces of the image carriers;

a pattern creation unit configured to create color misregistration detection patterns on the transfer unit by the toner image in a reference color formed by a light beam emitted from an exposing unit and the toner image in an adjustment color formed by the light beam emitted from a different exposing unit and having a different scanning direction from the light beam corresponding to the reference color;

an adjustment amount detection unit configured to detect a color misregistration adjustment amount by means of the color misregistration detection patterns created on the transfer unit; and a color misregistration correction unit configured, on the basis of the image forming position of the toner image in the reference color, to move an image forming position of the toner image in the adjustment color formed by the light beam emitted from the different exposing unit and having the scanning direction opposite to the light beam corresponding to the reference color, according to the color misregistration adjustment amount detected by the adjustment amount detection unit, wherein the image forming apparatus further comprises a temperature detection unit configured to detect temperatures of the respective exposing units, and the color misregistration correction unit is configured, on the basis of the image forming position of the toner image in the reference color, to move the image forming positions of the toner images in colors formed by the light beams not used to the color misregistration detection pattern, according to the respective temperatures of the exposing units detected by the temperature detection unit.

2. The image forming apparatus according to claim 1, wherein the color misregistration correction unit is configured to move the image forming positions of the toner image in each color, on the basis of the image forming position of the toner image in the reference color, at a predetermined timing, by means of the color misregistration detection patterns including the color toner images in every color formed on the transfer unit by the respective light beams.

3. The image forming apparatus according to claim 1, wherein the color misregistration correction unit is configured to move the image forming positions of the toner image in each color, on the basis of the image forming position of the toner image in the reference color, at a predetermined timing, by means of the color misregistration detection patterns including the color toner images in every color formed on the transfer unit by the respective light beams.

4. The image forming apparatus according to claim 1, wherein the color misregistration detection pattern includes a band-shaped pattern made of the toner image in the reference color and a plurality of band-shaped patterns made of the toner image in the adjustment color in the same shape as the toner image in the reference color.

* * * * *